US005287564A

United States Patent [19]

Davenport

[11] Patent Number: 5,287,564

[45] Date of Patent: Feb. 22, 1994

[54] MULTI-PURPOSE WATER PRESSURE PLUNGER

[76] Inventor: Clyde F. Davenport, 405 Oakwood St., Greenwood, S.C. 29646

[21] Appl. No.: 39,506

[22] Filed: Mar. 29, 1993

Related U.S. Application Data

[63] Continuation of Ser. No. 709,835, Jun. 4, 1991, abandoned, which is a continuation-in-part of Ser. No. 498,287, Mar. 23, 1990, Pat. No. 5,020,166.

[51] Int. Cl.[5] ..... E03D 11/00

[52] U.S. Cl. ..... 4/255.05; 4/255.11

[58] Field of Search ..... 4/255-257, 4/255.01-255.12

[56] References Cited

U.S. PATENT DOCUMENTS

| | | | |
|---|---|---|---|
| 1,821,900 | 9/1931 | Silvers | 4/255 X |
| 2,267,064 | 12/1941 | Wikeland | 4/255 |
| 4,238,860 | 12/1980 | Dixon | 4/257 X |
| 4,320,539 | 3/1982 | Li | 4/256 |
| 4,768,237 | 9/1988 | Torti | 4/256 |

FOREIGN PATENT DOCUMENTS

| | | | |
|---|---|---|---|
| 1003027 | 9/1965 | United Kingdom | 4/255.05 |

*Primary Examiner*—Charles E. Phillips
*Attorney, Agent, or Firm*—Hardaway Law Firm

[57] ABSTRACT

A multi-purpose water pressure plunger employs a source of pressurized water to dislodge clogs in bathroom drainage pipes and the like. The plunger is fashioned of a resilient cone-shaped cup, a rigid handle, an adjustable valve, and a means of connection to a pressurized source of water. Sealing against and partially extending into a drain opening, the cup permits full thrust of pressurized water into a drainage pipe without a backflow of water. The cup consists of an upper, deformable portion, and a solid, occlusive bottom portion defining a nipple-shaped end. A flow of pressurized water is supplied to the cup through an elongated and ridged handle with a lengthwise aperture therethrough. An adjustable valve including a ball component and a regulating lever controls the flow of water into the handle, and thus, to the clogged drain.

For oddly-shaped and rounded drainage openings, the multi-purpose water pressure plunger has a sealing attachment including a compressible cup having a barrel-like bottom and an occlusive semi-spherical disc. When inserted, the barrel-like bottom partially extends into a drainage opening, and when pressed downwardly, the semi-spherical disc seals the barrel-like bottom against walls of a drainage opening, and the perimeter of the compressible cup envelopes around the barrel-like bottom.

4 Claims, 4 Drawing Sheets

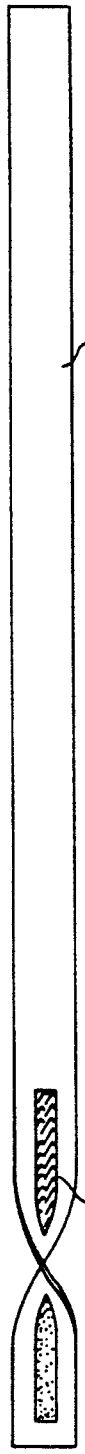
FIG. 8
FIG. 7
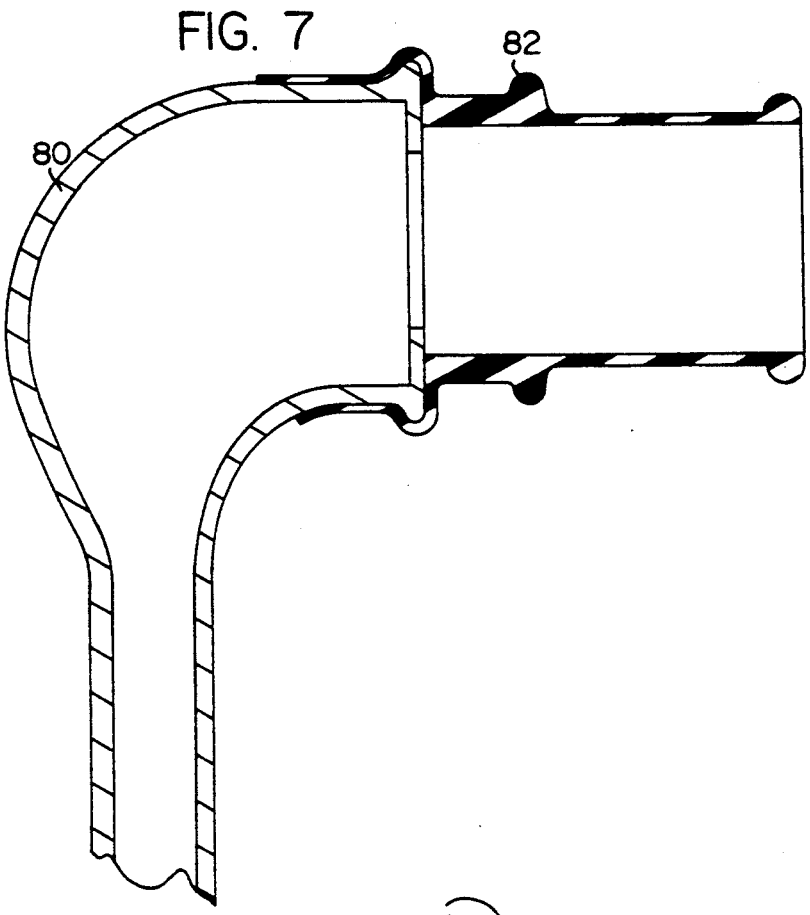
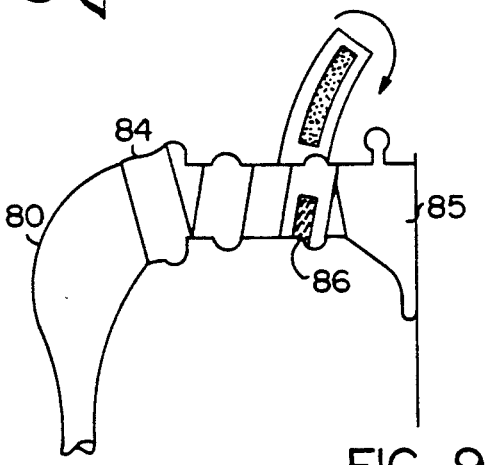
FIG. 9

MULTI-PURPOSE WATER PRESSURE PLUNGER

CROSS REFERENCE TO RELATED APPLICATIONS

This application is a continuation of application of Ser. No. 07/709,835 filed Jun. 4, 1991 now abandoned, which application is a continuation-in-part of application Ser. No. 07/498,287 filed Mar. 23, 1990 now U.S. Pat. No. 5,020,166.

BACKGROUND OF THE INVENTION

This invention relates generally to the art of drain clearing devices, and more particularly, to drain clearing devices which utilize pressurized water to eliminate drainage obstructions which occur in bathroom pipes and the like.

The art of unclogging drainage pipes is well known and has conventionally employed manually-operated devices of the type comprising a resiliently collapsible, rounded cup having an open interior cavity. Attached to the cup is an elongated handle element extending from the end thereof opposite the open interior cavity. The cup is placed over a drainage entrance, and by applying a downward and upward force to the handle, the cup is alternately compressed and expanded. The suction caused by this motion is generally effective in loosening small drainage clogs, however, larger obstructions may not be budged by such manual devices. One such device is disclosed in U.S. Pat. No. 4,622,702 to Allen wherein a manually operated plunger includes a collapsible cup for covering and sealing around a drain opening.

U.S. Pat. No. 4,674,137 to Girse discloses an electrically operated cup attached to a manually operated pumping member.

The art of clearing drainage pipes has also employed pressurized water for forcing a clog from its lodged position into the sewer system. These pressurized devices are of the type comprising a resilient drain sealing member of differing shapes and sizes. An elongated handle, having a lengthwise passage therethrough, communicates with the sealing member and extends from the end thereof opposite the sealing member. A flow of pressurized water passes into and through the handle consequently entering the drain which is proportionately embraced by the sealing member.

One such device is disclosed in U.S. Pat. No. 3,537,113 to Elzner wherein a collapsible cup of the conventional type covers and seals around the opening of a drain. A flow of pressurized water, controlled by a faucet-type valve, passes through the handle and into the drain.

U.S. Pat. No. 4,768,237 to Torti discloses a tubular handle element attached to a mushroom-shaped cup having a check valve to prevent a backflow of water. A female means on the opposite end of the handle allows the connection to a pressurized source of water.

U.S. Pat. No. 4,320,539 to Li discloses an elongated pipe with a manually operated plunger valve which activates a flow of pressurized water. A side arm, branching from and communicating with the pipe, is attached to a source of pressurized water by a male means of connection.

While the above prior art devices may perform satisfactorily in many instances, they are often incapable of providing a sanitary and efficient means of unclogging bathroom drains and the like. In particular, the drain clearing devices of the prior art are not constructed to allow for a secure enough seal of a drain opening, they do not permit the correct thrust of pressurized water to a clog, and they do not afford themselves to easy operation by the ultimate consumer.

SUMMARY OF THE INVENTION

It is therefore an object of this invention to provide a multi-purpose water pressure plunger of the type transcending the encumbrances of the prior art.

It is a further object of this invention to provide a multipurpose water pressure plunger which is safe and easy to use and which connects to any standard source of pressurized water.

It is a still further object of this invention to provide a multi-purpose water pressure plunger which completely seals a drain opening and which generates a direct impact of pressurized water to a drainage clog.

It is a still further object of this invention to provide a multi-purpose water pressure plunger which seals for oddly-shaped and rounded drainage openings.

It is still a further object of this invention to provide a multi-purpose water pressure plunger which can be more conveniently used that those of the type utilizing a handle.

It is a still further object of this invention to provide a multi-purpose water pressure plunger which easily and securely connects to a faucet.

These, as well as other objects, are accomplished by a multi- a multi-purpose water pressure plunger employing a source of pressurized water to dislodge clogs in bathroom drainage pipes and the like. The plunger is fashioned of a resilient cone-shaped cup, a rigid handle, an adjustable valve, and a means of connection to a pressurized source of water. Sealing against and partially extending into a drain opening, the cup permits full thrust of pressurized water into a drainage pipe without a backflow of water. The cup consists of an upper, deformable portion, and a solid, occlusive bottom portion defining a nipple-shaped end. A flow of pressurized water is supplied to the cup through a firm and elongated handle with a lengthwise aperture therethrough. An adjustable valve including a ball component and a regulating lever controls the flow of water into the handle, and thus, to the clogged drain.

For oddly-shaped and rounded drainage openings, the multipurpose water pressure plunger has a sealing attachment including a compressible cup having a barrel-like bottom and an occlusive semi-spherical disc. When inserted, the barrel-like bottom partially extends into a drainage opening, and when pressed downwardly, the semi-spherical disc seals the barrel-like bottom against walls of a drainage opening, and the perimeter of the compressible cup envelopes round the barrel-like bottom.

BRIEF DESCRIPTION OF THE DRAWINGS

FIG. 7 of the drawings illustrates a cross-sectional view of the faucet adapter according to this invention.

FIG. 8 of the drawings is a perspective view illustrating a constrictor band according to this invention.

FIG. 9 is a perspective view of a faucet having a faucet adapter and constrictor band thereon according to this invention.

DETAILED DESCRIPTION

In accordance with this invention it has been discovered that clogged drainage pipes can be easily and effectively cleared by using a flow of pressurized water. It has also been discovered that a drainage entrance must first be properly sealed to permit full thrust of pressurized water to a clog. It has additionally been found that a cone-shaped cup, comprising a flexible top and a solid bottom portion defining a nipple-shaped end, provides a tight, secure, and complete seal once inserted into the entrance of a drainage pipe. It has further been discovered that all drainage openings are not of the same shape and size, hence a sealing attachment comprising a compressible cup having a barrel-like bottom will fit and seal oddly-shaped and rounded drainage openings. Various other advantages will become apparent from the following description giving with reference to the various FIGURES of drawing.

Figure 1:
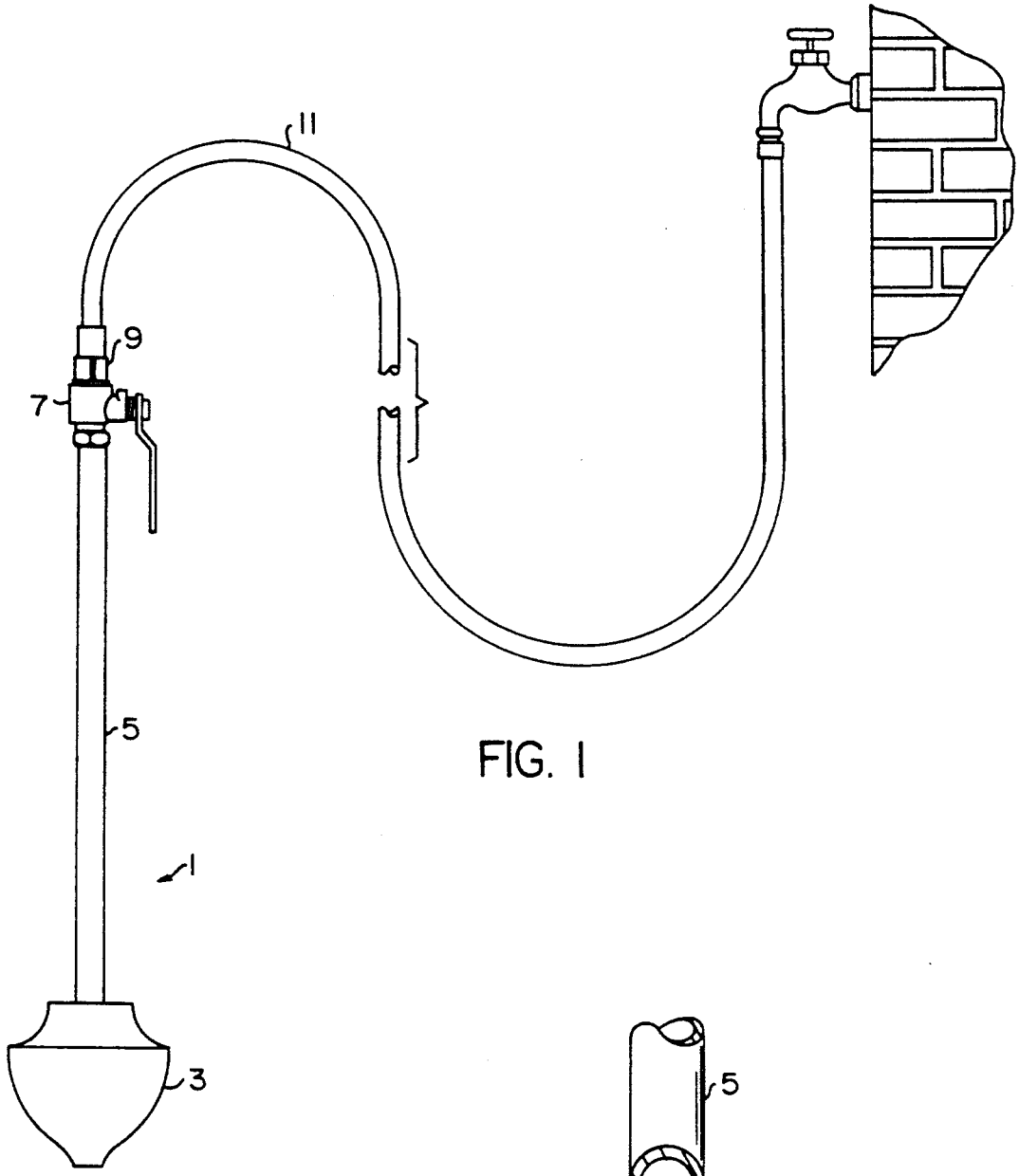
FIG. 1 of the drawings illustrates a perspective view of a multi-purpose water pressure plunger in accordance with the invention.

FIG. 1 of the drawings illustrates a multi-purpose water pressure plunger 1 in accordance with this invention. The plunger illustrated here comprises a cone-shaped member 3, a firm, elongated handle 5, an adjustable valve 7, and a means for connection 9 to a pressurized source of water 11.

Figure 2:
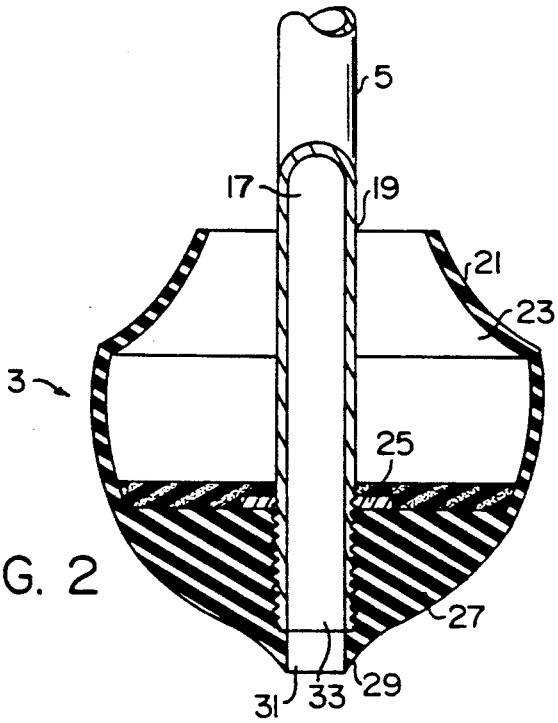
FIG. 2 of the drawings illustrates a cross-sectional view of a cone-shaped member and a firm, elongated handle in accordance with the invention.

FIG. 2 of the drawings illustrates the cone-shaped member 3 which may be of resilient, rubberized material heretofore utilized. It is fashioned with a nipple-shaped end 29 which partially extends into a drain opening. An occlusive bottom portion 27 allows for the secure seal against and inside a drainage entrance. The bottom portion 27 is solid in construction and is of the same rubberized material as the remainder of the cone-shaped member 3. A flexible top portion 21 allows a conformable seal to a drain opening. Through the cone-shaped member 3 runs a central passage 31 beginning at a substantially round opening 19 and terminating in nipple-shaped end 29. Central passage 31 defines an inner wall where central passage 31 passes through solid bottom portion 27. A circular pressure disc 25 is embedded in the rubberized material of the solid bottom portion 27 and is engaged upon the firm, elongated handle 5. This association between the firm, elongated handle 5 and the round pressure disc 25 allows leverage for manipulating the solid bottom portion 27 to form a firm drainage seal. As illustrated in FIG. 2, cone-shaped member 3 is rounded on its exterior defining a convex shape in cross-section with the exterior increasing in diameter from bottom portion 27 to an area of maximum diameter where agile top portion 21 begins. At this area of maximum diameter, agile top portion 21, also rounded on its exterior defining a concave shape in cross-section, decreases in diameter toward round opening 19.

Through a substantially round opening 19, the end of the firm, elongated handle 5 extends into the flexible top portion 21 of the cone-shaped member 3 through central passage 31, the extension terminating in the nipple-shaped end 29. The firm, elongated handle 5 is preferably formed of sturdy, non-corrosive metal, PVC pipe, or the like. A lengthwise aperture 17 runs inside the firm, elongated handle 5 providing a channel through which a flow of pressurized water will travel from its source 11 to the ultimate drainage clog. The firm, elongated handle 5 has an open end 33 which lies in the nipple-shaped end 29. The portion of elongated handle 5 which extends into and contacts solid bottom portion 27 is embedded in the inner wall of central passage 31 so that the diameter of the channel provided by lengthwise aperture 17 is preferably close to or the same as the diameter of central passage 31 and the portion of handle 5 defining open end 33 is generally not visible from the bottom of nipple-shaped end 29. Opposite the open end 33, the firm, elongated handle 5 has a female means for connection 9 to a pressurized source of water 11.

Figure 3:
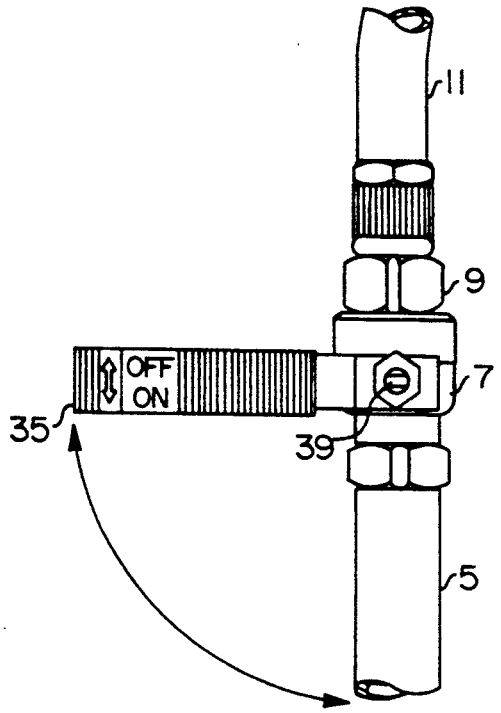
FIG. 3 of the drawings illustrates a sectional view of an adjustable valve in accordance with the invention.

FIG. 3 of the drawings illustrates an adjustable valve 7 positioned on the end of the firm, elongated handle 5 opposite the cone-shaped member 3. The adjustable valve 7 is fashioned from leak-proof and non-corrosive materials which have suitable coatings, platings, and flow characteristics for the intended application. A regulating lever 35 controls a ball component (not shown in the drawings) which in turn governs the flow of water from the pressurized source 11 through the lengthwise aperture 17. The regulating lever 35, attached to the adjustable valve 7 by a screw 39, prohibits a flow of water when it is moved perpendicular to the firm, elongated handle 5. When the regulating lever 35 is moved downward from its "off" position, a flow of water begins. A full thrust of pressurized water is realized when the regulating lever 35 becomes fully parallel to the elongated firm handle 5.

During operation, a pressurized source of water 11 such as a faucet is connected to the female means 9 by a hose which can be a garden hose or the like. The regulating lever 35 will remain in the "Off" position perpendicular to the firm, elongated handle 5 until the cone-shaped member 3 is properly positioned. When the nipple-shaped end 29 is inserted into a clogged drainage pipe and the solid bottom 27 has securely formed a tight seal against and inside the drainage entrance, the regulating lever 35 is pushed downward allowing the flow of water through the lengthwise aperture 17 inside the firm, elongated handle 5. The flow of water continues through the cone-shaped member 3 and out nipple-shaped end 29 and into the clogged drain. The tight seal of the cone-shaped member 3 will prevent a backflow of water and the regulating lever 35 will permit the appropriate flow of water to the clog. To dislodge a large obstruction, the regulating lever 35 is pushed parallel to the elongated firm handle 5 which will allow a full thrust of pressurized water into the drain, effectively and safely pushing the clog from its lodged position into the sewer system.

The cone-shaped member 3 is designed to fit almost any size drain opening. The flexible top portion 21 can conform to any size opening should the solid bottom portion 27 be unable to secure a tight enough seal.

Figure 4:
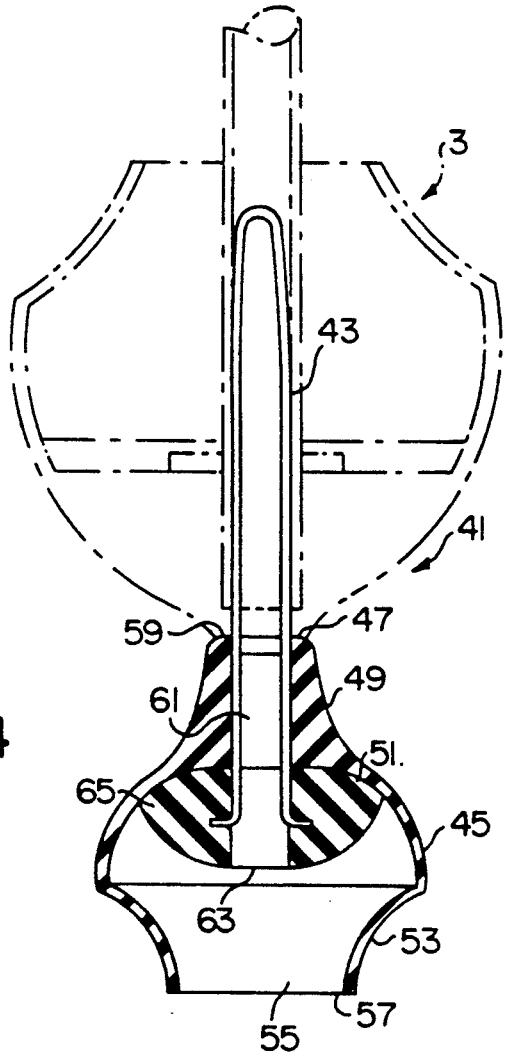
FIG. 4 of the drawings illustrates a cross-sectional view of a sealing attachment in accordance with this invention.

FIG. 4 of the drawings illustrates a sealing attachment 41 comprising a spring wire 43 attached to and extending from a compressible cup 45 consisting of a semi-spherical disc 51 formed of a solid and occlusive rubberized material, an interior cavity 55, and a barrel-like bottom 53. Spring wire 43 is elongated, substantially U-shaped, and consisting of a springy, non-corrosive metal or steel having unattached ends 65 engaged in semi-spherical disc 51 and being elongated and longitudinally extending through a lengthwise interior passage 61 along the perimeter thereof and for several inches opposite a substantially circular opening 59. The upper portion 49 of compressible cup 45 is fashioned of a solid rubberized material with semi-spherical disc 51 fixedly attached thereon inside interior cavity 55 and including circular opening 59 which communicates with lengthwise interior passage 61 beginning at circular opening 59 and extending through upper portion 49 and continuing through semi-spherical disc 51 and terminating thereon at an open end 63. Barrel-like bottom 51 is constructed of a resilient and deformable rubberized material having a circumferential orifice 57.

Sealing attachment 41 comprises compressible cup 45 which is agile and occlusive providing a flexible and secure seal to oddly-shaped and rounded drainage openings. When in operation, sealing attachment 41 is affixed to cone-shaped member 3 by insertion of spring wire 43 through central passage 31 into lengthwise aperture 17 of firm, elongated handle 5. An expansion of spring wire 43 inside lengthwise aperture 17 holds compressible cup 45 firmly in place with additional support provided by nipple-shaped end 29 accordingly fitting into entrance 47 of compressible cup 45 which conforms to the contour thereof. A source of pressurized water 11 is attached to female means 9. The regulating lever 35 will remain in the "Off" position perpendicular to the elongated firm handle 5 until compressible cup 45 is placed in proper position. Barrel-like bottom 53 is partially inserted into a drainage opening and a downward pressure is applied to cone-shaped member 3 using firm, elongated handle 5 resulting in the deformation of compressible cup 45 thereby causing semi-spherical disc 51 to extend downwardly into interior cavity 55 sealing barrel-like bottom 53 against walls of a drainage opening. Accordingly, the perimeter of compressible cup 45 envelopes around barrel-like bottom 53 as regulating lever 35 is pushed downward allowing the flow of water through the lengthwise aperture 17 inside firm, elongated handle 5. The flow of water continues through the cone-shaped member 3 via central passage 31 and out nipple-shaped end 29 of cone-shaped member into lengthwise interior passage 61 of compressible cup 45 and finally to the clogged drain. Since the semi-spherical disc is positioned substantially over the drainage opening and buttresses the barrel-like bottom against the walls of a drainage opening, a full thrust of pressurized water can enter the drainage pipe without a backflow of unsanitary water.

The multi-purpose water pressure plunger, in accordance with this invention, exhibits superior qualities not found in the prior art. The cone-shaped cup is both agile and occlusive and provides a flexible and secure seal to almost any size drain opening. The present invention produces a tight seal, especially important in preventing a backflow of unsanitary water and necessary to flush a clog from drainage pipe into a sewer system.

Figure 5:
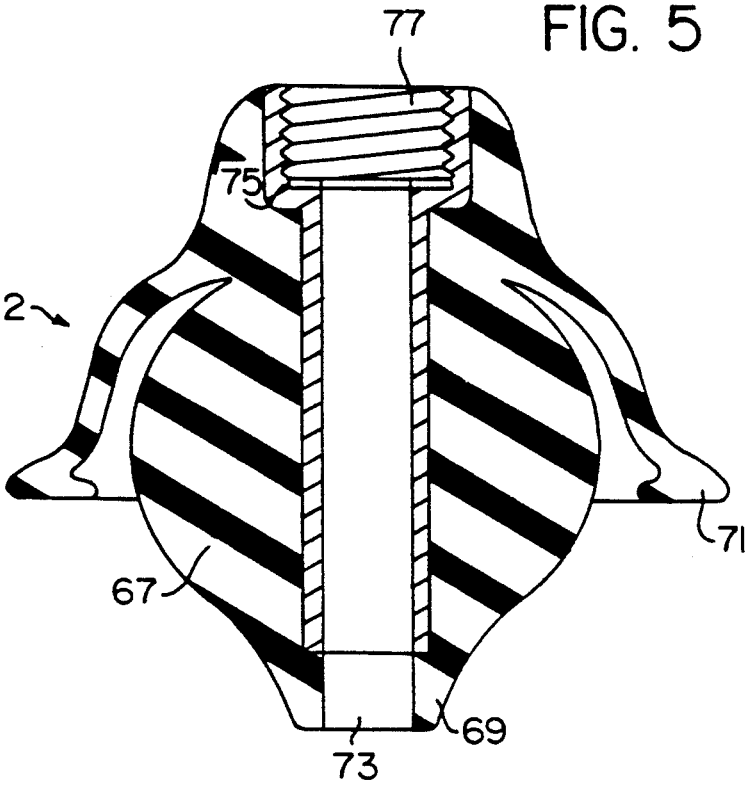
FIG. 5 of the drawings illustrates a cross-sectional view of another embodiment of the water pressure plunger in accordance with this invention.

FIG. 5 of the drawings illustrates a cross section of another embodiment of a water pressure plunger 2 according to this invention. As shown, this water pressure plunger 2 comprises a ball-shaped member 67 having a bottom portion defining a nipple-shaped open end 69. Ball-shaped member 67 may be of resilient, rubberized material heretofore utilized. Nipple-shaped open end 69 is designed to partially extend into a drain opening.

Ball-shaped member 67 has a top portion which extends to form an inverted cup 71, which surrounds ball-shaped member 67. Again, cup 71 may be of rubberized material heretofore utilized. Ball-shaped member 67 and cup 71 are envisioned as being a unitary structure.

Ball-shaped member 67 and cup 71 define an open central passage 73 therethrough which terminates in the nipple-shaped open end 69. Central passage 73 is shown lined with a rubber washer 75, which terminates in nipple-shaped end 69 and extends fully through central passage 73 opposite nipple-shaped end 69. An insert 77 is positioned inside central passage 73, with rubber washer 75 providing a good seal. Insert 77 may be formed of plastic or other material and is adapted to receive a standard water hose pipe at an end opposite nipple-shaped end 69. It is through insert 77 and central passage 73 that a flow of pressurized water travels to flush a drainage clog.

When in use, the water pressure plunger 2 has a standard water hose screwed into insert 77 opposite the nipple-shaped end 69. Water pressure plunger 2 can then be manually pressed partially into a drain opening. Pressure on ball-shaped member 67 and nipple-shaped end 69 cause the drain opening to be tightly sealed. A flow of pressurized water is then allowed to flow, preferably by use of an adjustable valve fitted between insert 77 and the water hose, through insert 77. This flow of water continues through insert 77, out nipple-shaped open end 69, and into the clogged drain. The tight seal of insert 77 with the water hose is also enhanced by rubber washer 75. The seal provided by nipple-shaped open end 69 helps prevent any back flow, and inverted cup 71 further prevents any kind of wash back from the drain.

Figure 6:
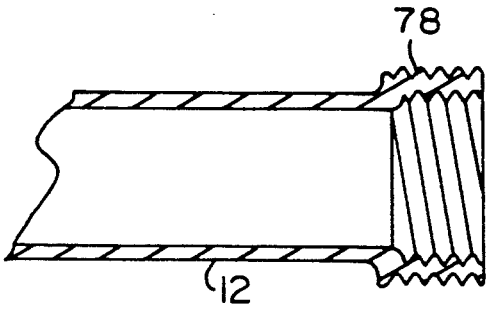
FIG. 6 of the drawings is a partial perspective view of a standard garden hose according to this invention.

A standard garden hose 12, illustrated in FIG. 6, can be fitted into insert 77 and then connected to a faucet 85 as in FIG. 9. Hose 12 has a threaded end 78 which fits into insert 77. To easily connect such a hose 12 to faucet 85, faucet adapter 80 is provided, as illustrated in FIG. 7. Faucet adapter 80 can be removably or fixedly attached onto hose 12, which is attached to plunger 2 at its other end. It is then possible for faucet adapter 80 to simply be fitted or pushed upon faucet 85, as partially illustrated in FIG. 8. Faucet adapter 80 is preferably formed from rubber so as to provide a good seal.

In order to allow faucet adapter 80 to fit different sizes of faucets, sleeve 82 as illustrated, in FIG. 7, is also provided. Sleeve 82 is also preferably formed of rubber and is shaped such that it can fit onto faucet 85 at one end and faucet adapter 80 can fit into sleeve 82 at its other end, thereby forming a tight seal. A constrictor band 84, illustrated in FIG. 8, is also provided and can be used to further seal faucet adapter 80 and sleeve 82 onto faucet 85 by winding constrictor band 84 thereon. Constrictor band 84 preferably is formed of rubber or elastic and has velcro 86 thereon to enable constrictor band 84 to be easily and quickly wound around faucet 85, sleeve 82 and faucet adapter 80. FIG. 9 illustrates the connection described above. As illustrated in the preferred embodiment, pressurized source of water 11 is faucet 85 and has sleeve 82 (partially illustrated) fittingly attached onto the faucet at one end with faucet adapter 80 fitted into sleeve 82 at the other end. Constrictor band 84 is shown would around the structures, with constrictor band 84 having velcro thereon for easier use.

It is apparent, therefore, that water pressure plunger 2 does not require a handle, thus this embodiment of water pressure plunger 2 is more convenient to use and takes up little space when compared with other devices used to unclog drains which utilize a handle portion.

It is thus seen in accordance with this invention a greatly improved water pressure plunger has been provided wherein a resilient, cone-shaped cup, comprising an agile top portion and a solid, occlusive bottom portion defining a nipple-shaped end, provides a secure and complete seal of a drain opening to permit an uninterrupted flow of pressurized water to flush a drainage clog into the sewer system without a backflow of unsanitary water. Additionally, an improved multi-purpose water pressure plunger has been provided including a sealing attachment which seals oddly-shaped or rounded drainage openings. The sealing attachment includes a compressible cup having a barrel-like bottom and an occlusive semi-spherical disc which buttresses the barrel-shaped bottom to walls of a drainage opening. It is also seen that a water pressure plunger has been provided which can be easily and securely connected to a faucet. It is also seen in accordance with this invention that a water pressure plunger has been provided which can more conveniently be used than those of the type utilizing handles.

As various modifications will become apparent to those in the art from a reading of the above description, such modification are within the breadth of this invention as fall within the spirit and scope of the following appended claims.

That which is claimed:

1. A multi-purpose water pressure plunger which sanitarily, efficiently, and dependably utilizes water pressure to clear clogged bathroom drains and the like, the improvement comprising:

a resilient, generally cone-shaped member for sealing against and partially extending into a drain opening, said cone-shaped member including an agile top portion and a solid, occlusive bottom portion, said bottom portion defining a nipple-shaped end which partially extends into a drain, said cone-shaped member having an open central passage therethrough which defines an inner wall therethrough in said bottom portion which terminates in a first opening in said nipple-shaped end;

said cone-shaped member being exteriorly rounded defining a convex shape in cross-section, in increasing diameter from said first opening to an area of maximum diameter where said agile top portion begins, said agile top portion extending to define a second opening opposite and coaxial with said first opening, said agile top portion also being exteriorly rounded defining a concave shape in cross-section and decreasing in diameter from said area of maximum diameter to said second opening;

a firm, elongated handle extending through said second opening and being attached to said cone-shaped member in said bottom portion thereof, adjacent said nipple-shaped end, said handle having a lengthwise aperture therethrough and having an open end which extends into said central passage;

said open end of said handle terminating proximate said nipple-shaped end and said handle and its open end that extends into said central passage being embedded in said inner wall of said bottom portion;

an adjustable leak-proof valve made of non-corrosive material for controlling a flow of water, said adjustable valve including a ball component and a regulating lever, said ball component positioned inside said firm, elongated handle and communicating with said aperture, said regulating lever being positioned externally of said handle and governing said ball component, said adjustable valve located on opposite end of said handle element from said cone-shaped member;

a means on said handle element for connection to a pressurized water source so that said water, regulated by said adjustable valve, is supplied to said central passage through said lengthwise aperture.

2. A multi-purpose water pressure plunger according to claim 1 wherein said means on said handle element for the connection to a pressurized source of water is of standard, threaded design and compatible with any standard, threaded source of pressurized water.

3. A multi-purpose water pressure plunger according to claim 1 wherein the length is approximately twenty-six inches, giving the user a conveniently operable length with which to perform the intended operation.

4. A multi-purpose water pressure plunger according to claim 1 wherein said solid bottom contains a round inner pressure disc on which said handle element is engaged, said pressure disc allowing leverage for applying force upon said cone-shaped member so as to form a tight drainage seal.

* * * * *